US005762122A

United States Patent [19]

Rice, Sr.

[11] Patent Number: 5,762,122

[45] Date of Patent: Jun. 9, 1998

[54] APPARATUS AND METHOD FOR MAKING WOOD CURLS

[75] Inventor: James T. Rice, Sr., Athens, Ga.

[73] Assignee: The University of Georgia Research Foundation, Inc., Athens, Ga.

[21] Appl. No.: 64,327

[22] Filed: May 18, 1993

Related U.S. Application Data

[63] Continuation-in-part of Ser. No. 856,136, Mar. 23, 1992, Pat. No. 5,211,688.

[51] Int. Cl.[6] ..... B27L 11/00

[52] U.S. Cl. ..... 144/373; 144/176; 144/242.1; 241/92; 241/278.1; 241/296

[58] Field of Search ..... 144/162 R, 172, 144/176, 218, 180, 242 R, 242.1, 373; 241/92, 278.1, 296, 298

[56] References Cited

U.S. PATENT DOCUMENTS

| | | | |
|---|---|---|---|
| 2,712,842 | 7/1955 | Fahrni | 144/172 |
| 3,101,756 | 8/1963 | Schubert | 144/172 |
| 3,332,461 | 7/1967 | Ledergerber | 144/172 |
| 3,378,210 | 4/1968 | Bambach . | |
| 4,000,860 | 1/1977 | Gotham . | |
| 4,164,329 | 8/1979 | Higby . | |
| 4,454,995 | 6/1984 | Bloomquist . | |
| 5,097,879 | 3/1992 | Rice, Sr. | 144/162 R |
| 5,211,688 | 5/1993 | Rice, Sr. | 144/162 R |
| 5,261,469 | 11/1993 | Severson | 144/162 R |

FOREIGN PATENT DOCUMENTS

| | | |
|---|---|---|
| 915249 | 1/1963 | United Kingdom . |
| WO 92/13687 | 8/1992 | WIPO . |

*Primary Examiner*—W. Donald Bray
*Attorney, Agent, or Firm*—Needle & Rosenberg, P.C

[57] ABSTRACT

A mechanized disc flaker for producing curled wood flakes having a rotatable disc plate, and one or more cutting knives mounted to the disc plate so as to provide for a slight "rake angle" defined in accordance with the invention as the angle made between the tool face and a plane perpendicular to the direction of tool travel. In a preferred embodiment, the apparatus includes rotatable and removable knife holders which permit the rake angle and the "cutting angle", defined in accordance with the invention as being the angle the cutting edge of the knife makes with the grain of the wood, to be modified to yield curled wood shavings having different geometries and characteristics. The preferred method of practicing the apparatus involves using a work piece having a certain moisture content which is directed against the work surface of the disc flaker using appropriate pressure all to provide for wood curls of desirable characteristics.

8 Claims, 8 Drawing Sheets

APPARATUS AND METHOD FOR MAKING WOOD CURLS

This application is a Continuation-in-Part of application U.S. Ser. No. 07/856,136 filed Mar. 23, 1992, U.S. Pat. No. 5,211,688.

BACKGROUND OF THE INVENTION

1. Field of the Invention

The present invention is concerned with the production of wood curls for various applications, such as potpourri, packing material and animal litter. The apparatus of the invention comprises a modified disc flaker which includes a cutting action at low rake angles to form curled wood shavings. One embodiment of the apparatus includes a rotatable knife which allows for varying the angle of the cutting edge of the knife relative to the motion of the knife and the angle of the cutting edge of the knife relative to the grain of the work piece. Such adjustments provide for the ability to produce curls of various geometries and characteristics and to further produce curls of consistent quality using various work pieces. The invention further includes methods of producing wood curls suitable for use with wood cutting machines of various designs.

2. Description of Prior Art

Myriad devices and methods for wood machining are known. Two basic processes predominate this art. A first process known as peripheral milling is largely concerned with manipulating the work piece to a desired shape and surface. Peripheral milling involves a rotary cutting process in which wood is removed in the form of single chips. The chips are formed by the intermittent engagement of the work piece by knives carried on the periphery of a rotating cutter head. The finished surface therefore consists of a series of individual knife traces generated by the successive engagement of each knife. A single surfacer with rotating cutter head illustrates the peripheral milling process.

A second process, employed by this invention, is known as orthogonal cutting. This process is primarily concerned with producing wood chips or flakes for various applications. In orthogonal cutting, the cutting edge is perpendicular to the direction of the relative motion of tool and work piece and the surface generated is in a plane parallel to the original work surface. The cutting action of a carpenter's hand plane and the cutting action employed by devices for the cutting of veneer used in making plywood illustrate orthogonal cutting.

Orthogonal cutting is utilized in various chipping machines. Such machines reduce pulpwood to more or less uniform chips required to manufacture chemical pulp. The uniform chips permit cooking liquor to penetrate the wood quickly, completely, and uniformly. Most chippers include a heavy rotating steel disc that is slotted on the face to receive chipping knives. Wood is presented to the rotating disc so that the knives remove chips. Wood chippers typically have a cutting action whereby the knives cut essentially through a cross section of the wood fibers to produce a flat, rough product. Orthogonal cutting is further utilized in wood flaking machines. Such machines cut flakes of more or less controlled dimensions. These flakes are used in making wafer board and oriented strand board.

The design of flakers is influenced by the form of the raw material introduced to the equipment, moisture content of the wood, the shape of flake desired, and the rate of production required. Peripheral milling devices, veneer lathes, and disc type flakers are well described in the art.

A key factor in determining the shape of a chip or flake is the rake angle. In the nomenclature of wood machining, the rake angle is often defined as the angle made between the tool face and a plane perpendicular to the direction of tool travel. Rake angle is also sometimes referred to as the hook angle, the chip angle, or the angle of attack. The pulp and paper, particle board, and flakeboard industries require flat chips and flakes. The prior art and literature teach the use of rake angles in the range of forty-five degrees to sixty degrees (45°–60°) to produce flat wood particles and teach away from the production of curled flakes.

U.S. Pat. No. 2,936,008 to Brown teaches a mobile chipping unit capable of producing flat wood chips from whole trees.

U.S. Pat. No. 2,969,095 to Bookhyser et al. teaches a feeding apparatus for a rotary wood flaker used in producing wood flakes for hardboard.

U.S. Pat. No. 3,032,281 to Wexell teaches a wood chipping machine having a rotatable chipper disc carrying a plurality of circumferentially spaced cutter knives with a particular securing means to secure the knives to the disc. Wexell teaches an elongated bolt head to ease in securing the knives to the disc and thus decrease the machine down time.

U.S. Pat. No. 3,237,663 to Kirster discloses a wood chipping apparatus for making chips where the feeding channel is designed to guide the work pieces to the cutter so that the pieces will be cut either parallel or perpendicular to the wood grain.

U.S. Pat. No. 4,346,744 to Beer et al. teaches a wood waferizing apparatus designed with knives mounted with cutting edges parallel to the grain.

U.S. Pat. No. 4,298,044 to Hansel et al. teaches a wood chipper having angularly space knife blades mounted on a rotating disc. The angularly spaced knife blades are adjacent to angularly spaced passageways where the wood is fed to the other side of the disc.

U.S. Pat. No. 4,685,497 to Mierau et al. teaches a wood waferizing apparatus having serrated, staggered disposable knives.

The above mentioned art discloses methods and machinery for producing flat wood chips, flakes or fibers. The rake angles used in the cited prior art are substantial.

The present invention is related to but distinct from disc flakers known in the prior art. The present invention, unlike the prior art, utilizes a relatively small rake angle to produce a wood curl instead of a flat wood chip or flake. Another factor important in producing durable and substantial wood curls is wood grain orientation. A notation developed by W. M. McKenzie is useful in describing wood grain orientation in the orthogonal cutting situation. For additional information about the notation see *Wood Machining Processes* by Peter Koch (Ronald Press Company, 1964, p. 36). This system consists of two numbers separated by a hyphen. The first number is the angle the cutting edge of the knife makes with the grain of the wood (hereinafter "cutting angle"). The second number is the angle that the tool motion vector makes with the grain of the wood. The vast majority of chippers and flakers known in the prior art have a cutting action described by the referenced nomenclature in the range of 90–45 to 90–90 for machines reducing wood to pulp chip form and approximately 0–90 for disc flakers producing flakes to be used in wood-based panels. In the case of a 90–90 cut, the cutting edge of the knife and the motion of the blade are both perpendicular to the grain. In the case of a 0–90 cut, the knife edge is parallel to the grain but the motion of the blade is perpendicular to the grain. For most situations, the cutting action for the present invention, in contrast, is described in accordance with the referenced nomenclature as in the range of 90–0 to 90–20, preferably in the range of 90–0 to 90–15. It should be noted that when cutting with a disc flaker, in accordance with the method of the invention, the circular motion of the disc results in the knife edge making a series of instantaneous angles relative to the grain ranging from approximately 45° to 90° and back to approximately 45°, as the knife sweeps through the work piece. Hence, the range of 90–0 to 90–20 actually refers to the knife edge angle to the grain when the knife is on the horizontal. Accordingly, unless otherwise indicated, references to angles made between the cutting edge of a knife and the wood grain of a work piece shall describe the angle made when the knife is on the horizontal. When using a disc flaker in accordance with the method of the invention, the knife edge is on the horizontal when the knife reaches the nine o'clock position as the disc rotates in a counter-clockwise direction. In accordance with the method of the invention, this means that the knife edge is perpendicular to the grain of the wood, and the knife motion is at a slight angle to and with the grain.

Curled wood flakes have many applications. Predominant uses are for packing, potpourri material, and animal bedding or litter. A commonly used packing material is polystyrene in the form of peanuts, worms, and shells. Although polystyrene has certain qualities which render it suitable for packing material, it has come to be recognized as an environmentally harmful substance. The chemicals used in the production of polystyrene have been associated with depletion of the ozone layer of the atmosphere. Polystyrene is not biodegradable.

Long, thin, grass-like strands of wood sometimes referred to as excelsior or wood wool, have also been used as packing material. Such material does not readily conform to the shape of the packaged object. Therefore, more labor is required to package an object with it. Such material also releases dust particles which may damage the packaged item and be untidy. The bulk density of most excelsior materials is not optimal for packaging purposes.

Paper is also used as a packing material. It is not as readily disposable as either excelsior or the wood curls produced by the present invention. Also, it may be necessary to use an amount of paper having a greater than desirable bulk density in order to adequately protect the packaged item.

Curled wood shavings produced in accordance with this invention are lightweight, relatively dust free, elastic, inexpensive and environmentally safe to manufacture and use. Curled shavings can be poured around an object being packed. They conform to its shape and require less manual arrangement than excelsior-like materials.

A second important application for wood curls is for potpourri materials. Traditionally, potpourri mixtures have been comprised of dried herbs and flowers. Recently, other materials such as stone, ceramic pieces and wood shavings have been treated with fragrant oil and added to potpourri. The wood shavings currently used in potpourri are typically flat wood scraps from industrial wood peripheral milling operations. These scraps tend to break up and splinter. They are also not very decorative and do not enhance the appearance of a potpourri mixture. Curled shavings are very decorative. They are also far more elastic and less subject to splintering than flat wood scraps. Curled shavings have greater surface area than flat wood scraps and therefore emit more fragrance. Wood curls represent a significant alternative to materials currently being used for animal litter. The supply of currently used materials is dwindling. It is believed wood curls release fewer fibers than other litter materials, such as hay. It is further believed that wood curls, processed in accordance with the methods of this invention and stored in a relatively dry and clean environment prior to use as litter material, probably harbor fewer disease causing agents, such as microbes, than straw or other conventional litter materials. Therefore, the use of wood curls as litter material may have a positive impact in managing animal disease.

SUMMARY OF THE INVENTION

The present invention provides devices and methods for mass producing curled wood flakes for various uses, such as packing, potpourri, and animal litter material.

According to one device of the present invention, one or more cutting knives are nonadjustably mounted to the work surface of the disc of a disc flaker. The knives are set to rake angles in the range of zero degrees to forty-five degrees (0°–45°), preferably in the range of zero to thirty degrees (0°–30°). The orientation of the grain of the work piece relative to the motion of the knife is an important factor in producing curls of different geometry and characteristics. The feed box and the work piece should be positioned relative to the work surface of the disc flaker so as to provide for a knife motion at a slight angle, in the range of zero to twenty degrees (0°–20°), preferably in the range of zero to fifteen degrees (0°–15°), to the grain of the wood to consistently obtain substantial curls. The orientation of the feed box and work piece relative to the work surface of the disc should further provide for a cutting action that is "with-the-grain" of the wood. In the terminology of wood machining, a disc flaker knife cutting down the face of a wood block, the grain of which is at an angle of five degrees (5°) off the vertical and with the grain lines of the wood leaning back and away from the disc and the knife, would be designated as making a ninety degree to five degree (90°–5°) with-the-grain cut.

According to another device of the present invention, the cutting knives are adjustably mounted to the work surface of the disc flaker. The knives are mounted using removable knife support inserts mounted in rotatable knife holders. The knife support inserts are machined so as to provide for various rake angles in the range of zero to forty-five degrees (0°–45°) when mounted with a knife in the knife holder. The ability to rotate the knife holders allows for the cutting angle between the knife edge and the grain of the wood to be adjusted. This angle is critical with respect to the shape and geometry of the curls produced. When the knife is on the horizontal and this angle is approximately ninety degrees (90°), a mostly non-helical curl is produced. Using specialized apparatus, such as the rotatable knife holder illustrated in figure nine, angles somewhat lower than ninety degrees (90°), typically in the range of eighty to forty-five degrees (80°–45°), may be used to obtain helical curls. Helical curls may also be achieved by presenting the work piece to the work surface of the disc flaker so that when the cutting edge of the knife is on the horizontal, the angle between the cutting edge of the knife and the grain of the wood is in the range of ninety to fifty degrees (90°–50°).

Such an "angled" presentation of the work piece may be achieved through various feed box modifications. One modification incorporates a gimbal means into a feed box, so as to permit the feed box to be adjusted to occupy various loci, throughout an eighty degree (80°) arc, such that when the feed box occupies the center of the arc, an angle of ninety degrees (90°) is made between the cutting edge of the knife and the grain of the work piece. An alternative feed box modification incorporates a vee shaped channel in the center of the feed box, which may be removable, into which work pieces may be fed to present such work pieces to the cutting edge of the knife in a similar "angled" manner.

Helical curls may interlock and therefore better stabilize a packaged item within its packing container than non-helical curls. Experience indicates that some may perceive helical curls to be more desirable than non-helical curls for animal litter applications because helical curls have a greater density than non-helical curls. Different rake angles and different angles between the cutting edge of the knife and the grain of the wood yield curls optimal for various packing and potpourri applications. The ability to vary these two angles is also useful in achieving standard curls with various types of work pieces. A rotatable knife allows for varying the angle of the cutting edge of the knife relative to the motion of the knife and the angle of the cutting edge of the knife relative to the grain of the work piece. Such adjustments provide the ability to produce curls of various geometries and characteristics and to produce curls of consistent quality using various work pieces. The invention permits adjustments so as to produce wood curls with different characteristics suitable for various applications.

All devices of the invention should include a means for using scoring knives. Scoring knives will be useful in cutting wide work pieces to provide for desirable curl lengths. The skilled artisan will recognize that many arrangements of scoring knives are known, which would be applicable for this invention. One arrangement would involve including arrays of scoring holes in the disc for receiving scoring knives. Other arrangements include linear, side-by-side arrays of scoring knives which may be separately mounted to the disc or a part of a cutting knife holder. In all devices of the invention, the feed box should be positioned so as to allow for full conversion of the blocks of wood used to make curls. This may be achieved by positioning the base of the feed box very close to the cutting plane of the knife edges, preferably within a distance less than a thickness of a curl.

All devices of the invention should be designed to promote complete utilization of work pieces to produce uniform and quality curls. Devices of the invention should further be designed so as to facilitate curl removal. Wood blocks of various dimensions may effectively be used as work pieces in accordance with this invention. However, it has been observed that work piece blocks, particularly those which are relatively short along the grain, may become cocked between the cutting tip of the knife edge and leading edge of the knife slot, during operation of the apparatus. Such work pieces may be fed in a manner which produces non-preferred curls. This problem may be minimized by positioning the cutting knives within their slots so that the clearance between the cutting tip of the knives and the leading edge of the knife slots is kept to a minimum, usually one-half of an inch. However, such a narrow clearance may, in some instances, cause some of the product curls to become impacted between the knife edge and adjacent slot wall, resulting in partial jamming and the production of some non-preferred curls. This problem may be minimized by machining away portions of the metal on the backside of the disc, proximate to the leading edges and ends of the knife slots, so as to create adequate space for product curls to flow freely through the disc and onto the off-bearing system. It is especially important to enlarge the clearance on the backside of the disc in the region around the outside tip of the knives. The problem of curl impaction is exacerbated when relatively thick discs are used.

In one embodiment of the invention, the disc may be mounted in bearings on the side of a heavy metal channel frame with the disc positioned so that about forty percent (40%) of it is the channel and about sixty percent (60%) above the channel. The curls produced by the cutting action would be directed toward a conveyor belt which would receive the curls and transport them to an appropriate accumulation container.

The moisture content of the work piece influences the characteristics of the curls produced. For certain applications, such as packing material, it may be preferable to produce curls that are light weight, particularly resilient under compression loading, and of a low fine particle content. Optimal results for such characteristics are achieved in accordance with the methods of this invention when the moisture content of the wood exceeds twenty-five percent (25%) on an oven dried basis. It is also possible, however, to produce curls useful for certain applications from wood having an extremely low moisture content or zero percent (0%) moisture on an oven dried basis. Curls produced using relatively dry wood are typically heavier, have a lower compression resiliency, and a higher fine particle content than curls produced using relatively moist wood. When using relatively dry work pieces, optimal results are obtained with low density wood.

The distance the knife is set to project beyond the face of the disc, in combination with the amount of pressure used to force the work piece against the disc and knife, plays a role in determining the thickness of the curls. Favorable results are achieved in accordance with the methods of this invention, when the cutting blades are set to project a distance in the range of 0.001 inches to 0.020 inches away from the work surface of the disc and toward the work piece and when the work piece experiences a force in the range of two to twenty (2–20) PSI, urging said work piece against said disc. Shavings which are too thin may not curl properly and may possess low compression resistance. Shavings which are too thick also may not curl properly, may have higher bulk densities than desirable for use as a packing material, and may be so brittle as to break up too easily. The height of the wood block plays an important role in determining the diameter of the curls produced.

It may, under some circumstances, be advisable to use metered feeding to introduce work pieces to the work surface of the disc. Metered feeding may enhance the useful life of cutting knives. In metered feeding, one sets the cutting knives to project a distance slightly greater than the desired curl flake thickness. The work piece is carried forward toward the work surface of the disc at a constant rate of advancement so that, in combination with the disc speed, typically measured in revolutions per minute, and number of cutting knives, the desired curl flake thickness is achieved. In non-metered feeding, the work piece may be forced against the work surface of the disc and the knife tip, causing excessive wear on the cutting knives. Experience indicates that a knife projection setting of 0.012 inches, combined with a properly controlled rate of feeding of work pieces, will produce useful curl flakes having a thickness of approximately 0.010 inches.

Useful knife life may further be optimized by the use of high quality knife compositions such as A-8 steel. In addition, manipulation of the bevel and clearance angles of the cutting knives will often serve to promote useful knife life. For purposes of this invention, the bevel angle is defined as the angle included within the cutting tip of the knife and lying between the face of the knife and bevel edge of the knife, and the clearance angle is defined as the angle between the bevel edge of the knife and the work surface behind the knife. The rake, bevel, and clearance angles always total ninety degrees (90°). Experience indicates that when using moist materials, a relatively high clearance angle, in the range of ten to thirty degrees (10°–30°) will help promote useful knife life. Smaller clearance angles may not be deleterious to useful knife life when relatively dry wood is used.

It is accordingly an object of this invention to use a disc flaker having knives with low rake angles to cut work pieces to create curled flakes.

It is an additional object of this invention to provide a means for adjustably mounting knives on a disc flaker so as to enable one to vary the rake angle and the angle between the knife edge and the grain of the wood to provide for curled flakes with different characteristics and to accommodate the characteristics of different work pieces.

It is a further object of this invention to position the feed box so as to present the grain of the work piece to the blade, such that the angle the tool motion vector makes with grain is in the range of zero degrees to twenty degrees (0°–20°), preferably in the range of zero to fifteen degrees (0°–15°).

It is a further object of this invention to position the feed box so as to present the work piece to the blade, so that the work piece is cut at a slight angle and with the grain. In accordance with the referenced nomenclature developed by W. M. McKenzie, such a cutting action would be described as being in the range of a 90–0 to a 90–20 cut.

It is a further object of this invention to include scoring blades on the disc work surface to permit the creation of curls of various length.

It is a further object of this invention to position the feed box to permit full conversion of work pieces to curled flakes.

It is a further object of the method of this invention to use wood of appropriate moisture content and temperature so as to produce curls having the desired characteristics for specific applications.

It is a further object of the method of this invention to control the feed pressure of the device to produce curls of the desired shape and characteristics.

Other objects, features and purposes of the invention will become apparent with respect to the remainder of this document.

DESCRIPTION OF THE DRAWINGS

The invention will now be described with reference to the accompanying drawings, which illustrate the preferred embodiments of the mechanized disc flaker of the present invention falling within the scope of the appended claims. For purposes of description the "front" of the disc shall mean the side facing the work piece. The "rear" of the disc shall mean the opposite side from which cut curls are ejected.

FIG. 21A is a front view of a section of the main disk and the feed box, wherein the feed box is positioned so that an angle of ninety degrees (90°) is formed between the cutting edge of the knife and the work piece.

FIG. 21B is a view of FIG. 21A in which the feed box has been rotated to the left forty degrees (40°) from horizonal, forming a vee shaped channel.

FIG. 21C is a view of FIG. 21A in which the feed box has been rotated to the right forty degrees (40°) from horizonal, forming a vee shaped channel.

DETAILED DESCRIPTION OF THE PREFERRED EMBODIMENT

Figure 1:
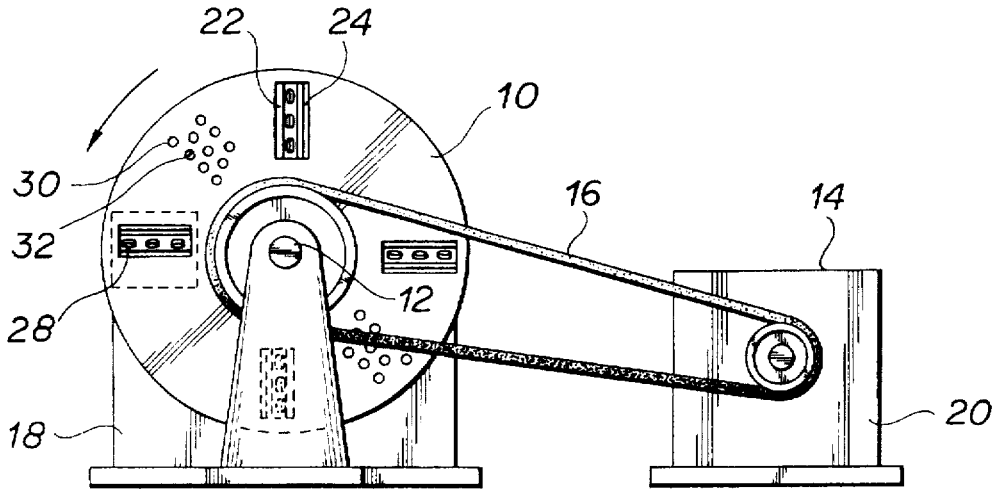
FIG. 1 is a rear view of the mechanized disc flaker illustrating the rotational direction of the disc.

Referring to FIG. 1, the apparatus consists of a disc plate 10 rotating about a shaft 12. In order to permit adequate production of curls for commercial purposes, the disc should be at least fifteen inches (15") in diameter and be able to accommodate knives at least three inches (3") in length. However, the diameter of the disc and the length of the knives may be varied to accommodate production needs. The shaft 12 is driven by an electric motor 14 by means of a continuous drive belt 16. Both the disc flaker housing 18 and motor housing 20 are securely mounted to adjacent structures to enable the apparatus to perform properly and without structural or alignment difficulties.

Figure 2:
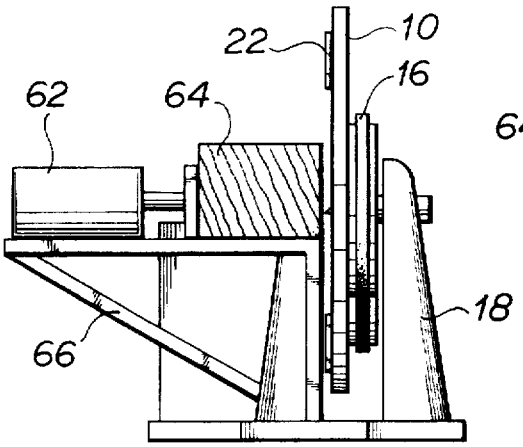
FIG. 2 is a side view of the disc flaker showing the pneumatic jack pushing the work piece into the work surface of the flaker.
Figure 3:
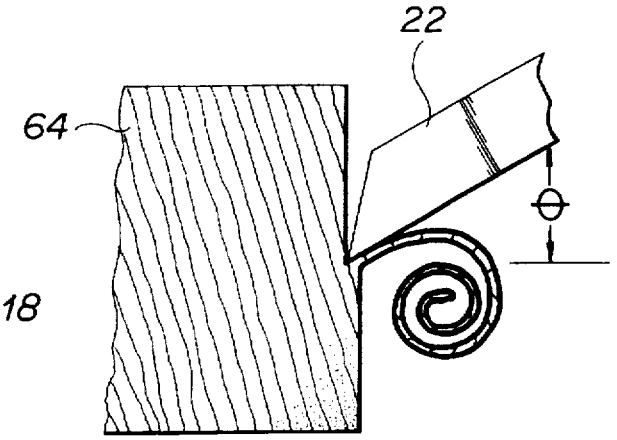
FIG. 3 is a side view of a work piece being cut substantially along and with the wood grain by a cutting knife with a rake angle of approximately thirty degrees (30°)

FIG. 2 illustrates that a pneumatic jack 62 is used to direct the work piece 64 into the face of the disc plate 10. The jack 62 is structurally supported by flanges 66 extending from the disc flaker housing 18.

The electric motor 14 drives the disc flaker using a continuous belt 16. As the disc plate 10 rotates, each blade 22 cuts into the work piece 64. Constant pressure provided by the pneumatic jack 62 continuously feeds the disc flaker. The blade 22 cuts through the work piece at a slight rake angle, cutting substantially with and along the wood grain to produce a curled wood flake.

Figure 4:
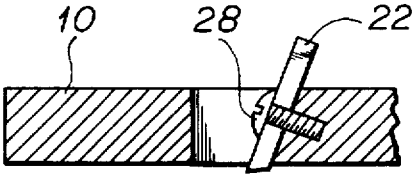
FIG. 4 is a sectional side view of a cutting blade nonadjustably mounted to the disc using a bolt and having a low rake angle.
Figure 5:
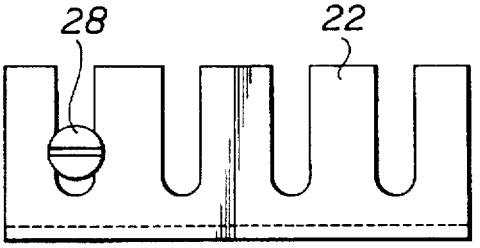
FIG. 5 is a detailed front view of a blade with elliptical grooves to receive mounting bolts.

Structurally integral with the disc plate 10 are the knife blades 22. The knife blades 22 are mounted in accordance with FIG. 4 directly to the disc 10 using a mounting bolt 28. The knife blade 22 shown in FIGS. 2 and 4 is mounted and ground so as to have a low rake angle. The preferred rake angle is in a range from zero degrees to thirty degrees (0°–30°).

Figure 6:
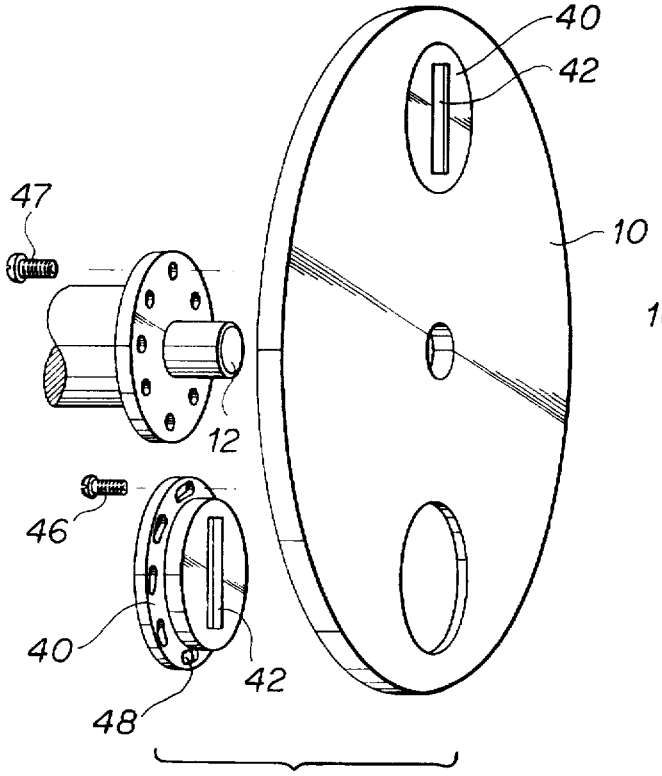
FIG. 6 is an exploded perspective of a disc with two knife holders radially aligned and further showing the shaft and bolts for mounting the main disc to said shaft.
Figure 7:
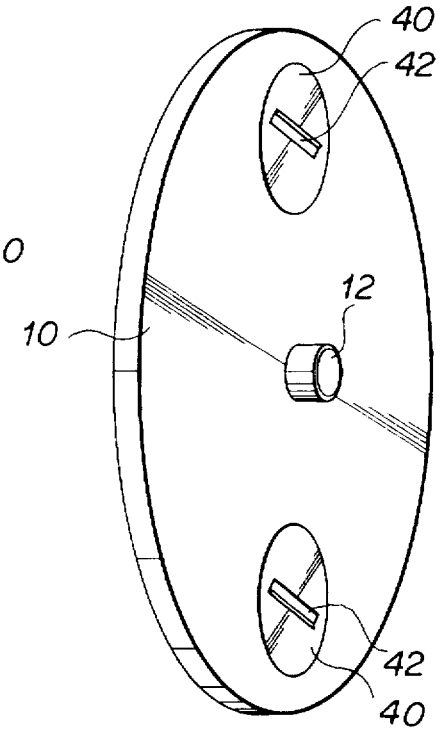
FIG. 7 is a perspective view of a disc with two knife holders rotated eighty degrees (80°)
Figure 9:
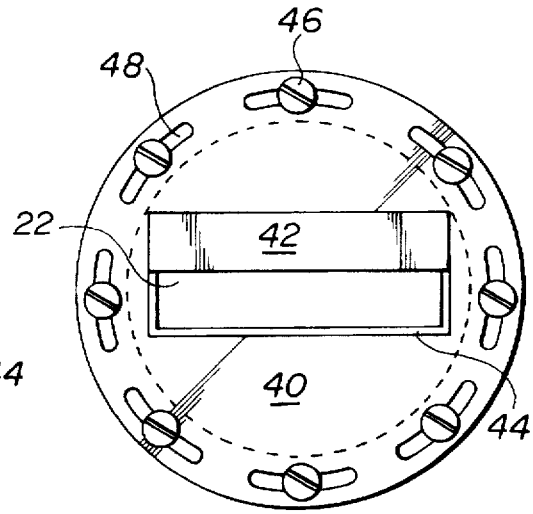
FIG. 9 is a rear view of a removable and rotatable knife holder disc.

In another preferred embodiment, the knives are mounted on the main disc using removable and rotatable knife holder discs. In accordance with FIGS. 6, 7, and 9, the removable and rotatable knife holder discs are adjustably mounted to the main disc. The knife holder discs 40 are mounted to the main disc 10 using a series of knife holder disc mounting bolts 46 which screw through elliptical slots machined into the periphery of the knife holding discs and into the main disc. In accordance with FIG. 9, the elliptical slots may be adjusted by loosening the screws, adjusting the position of the slots, and retightening the screws so that various angles may be made between the cutting edge of the knife and the grain of the work piece.

Figure 8:
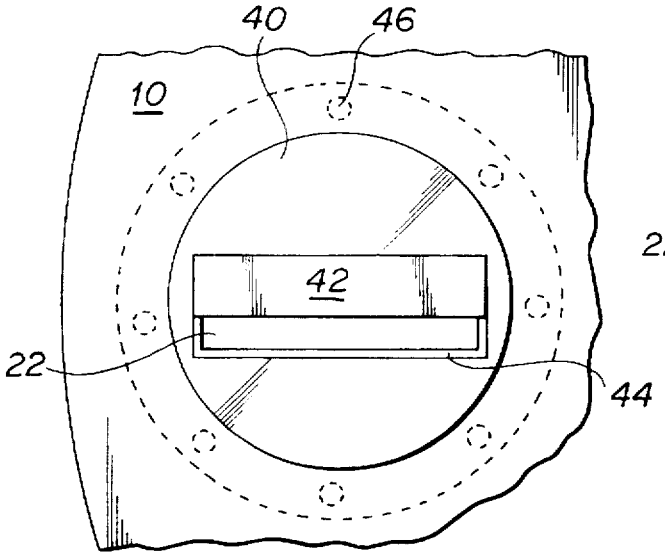
FIG. 8 is a partial cut-away section of a main disc viewed from the front and showing a removable and rotatable knife holder disc mounted to the section.

As shown in FIG. 8, there is an opening 44 for curl passage after a curl is cut from the work piece.

Figure 10:
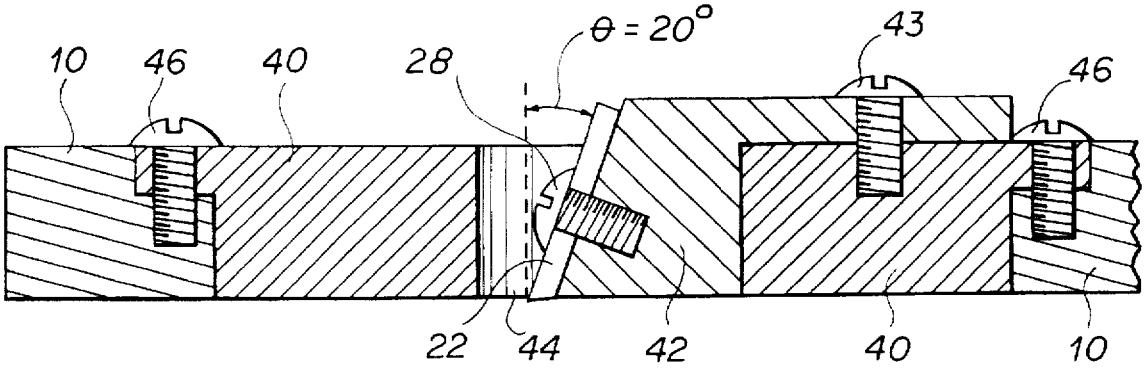
FIG. 10 is a side view cut-away of a removable and changeable knife support insert which allows for mounting a knife at a rake angle of twenty degrees (20°)
Figure 11:
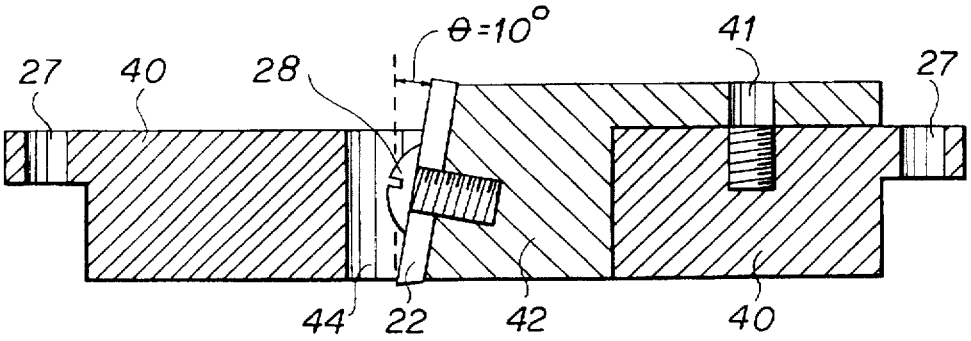
FIG. 11 is a side view cut-away of a removable and changeable knife support insert which allows for mounting a knife at a rake angle of ten degrees (10°)
Figure 12:
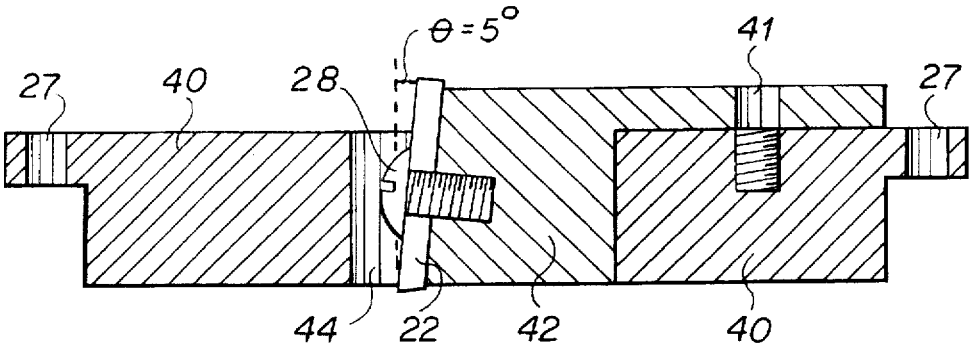
FIG. 12 is a side view cut-away of a removable and changeable knife support insert which allows for mounting a knife at five degrees (5°)

As illustrated in FIGS. 10, 11, and 12, the rotatable and removable discs may include knife holder inserts 42 which allow for knives to be mounted with various rake angles. The knives 22 are mounted to the removable and changeable knife support inserts 42 using a mounting bolt 28. The inserts are mounted to the knife holders using bolts 43. The knife holder is in turn mounted to the main disc using bolts 46.

Figure 13:
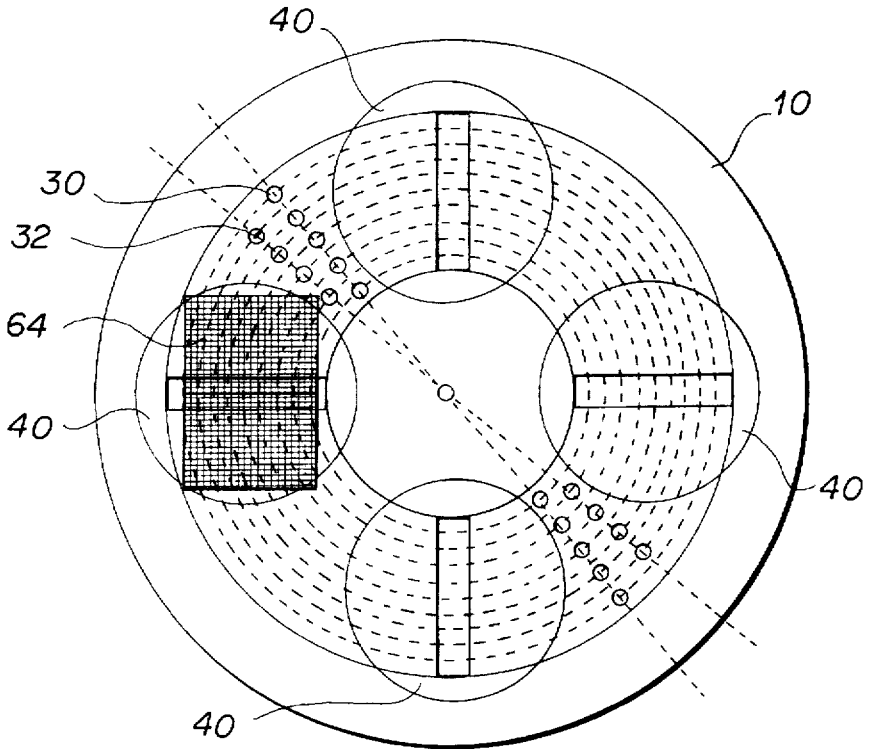
FIG. 13 is a rear view of a main disc with four knives mounted in removable and rotatable knife holders.
Figure 14:
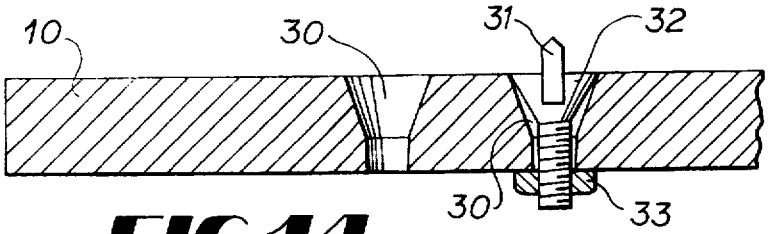
FIG. 14 is a sectional view of a main disc showing detail of a scoring knife and mounting hole.
Figures 15, 16, 17:
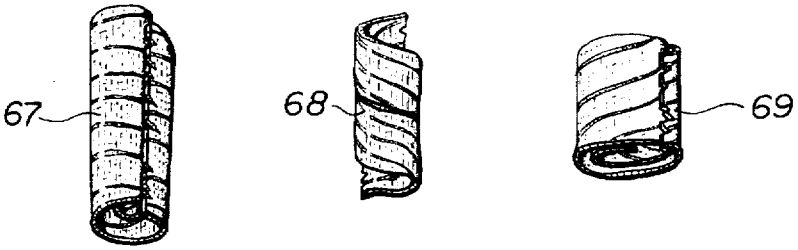
FIGS. 15, 16, and 17 are details of curls produced by the disc flaker.

FIG. 13 illustrates scoring knife mounting holes 30 and scoring knives 32 which extend radially along the face of the disc plate 10. Scoring knives 32 are held within the scoring holes 30 by an interference fit. The distance between the scoring knives may be varied to obtain curls of different diameter. Scoring holes approximately one-half inch (½") apart will produce curls of a diameter suitable for many purposes. A scoring knife 31 may be mounted in a scoring knife holder 32 which may be inserted in a scoring mount scoring hole 30. The scoring knife may be tightened within its holder using a tightening nut 33. FIG. 14 is a magnified cut-away view of a scoring knife mounting hole and a scoring knife mounted in a scoring knife mounting hole. As the disc plate 10 rotates, the scoring blades 32 cut the wood in lengthwise strips. The width and number of flakes depend on the number and spacing of scoring blades used. FIGS. 15, 16, and 17 illustrate representative curls of different lengths, diameter, and geometry produced by the apparatus and method of the invention.

Figure 18:
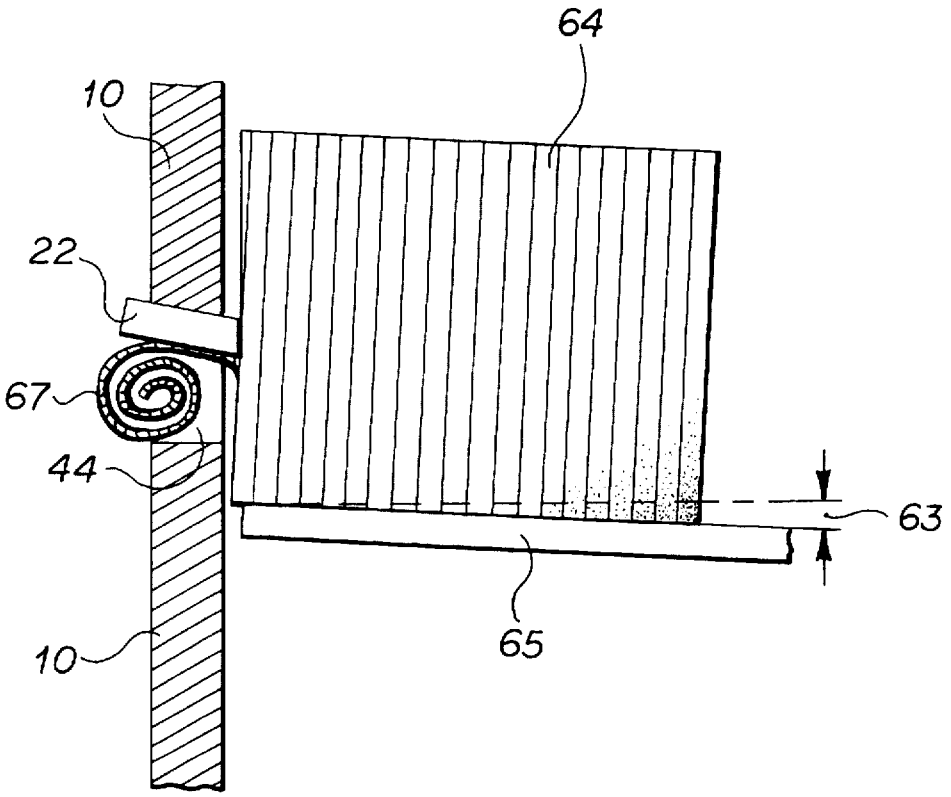
FIG. 18 is a side view cut-away showing a feed box with an angled platform allowing for an appropriate angle of knife motion to the wood grain.
Figure 19:
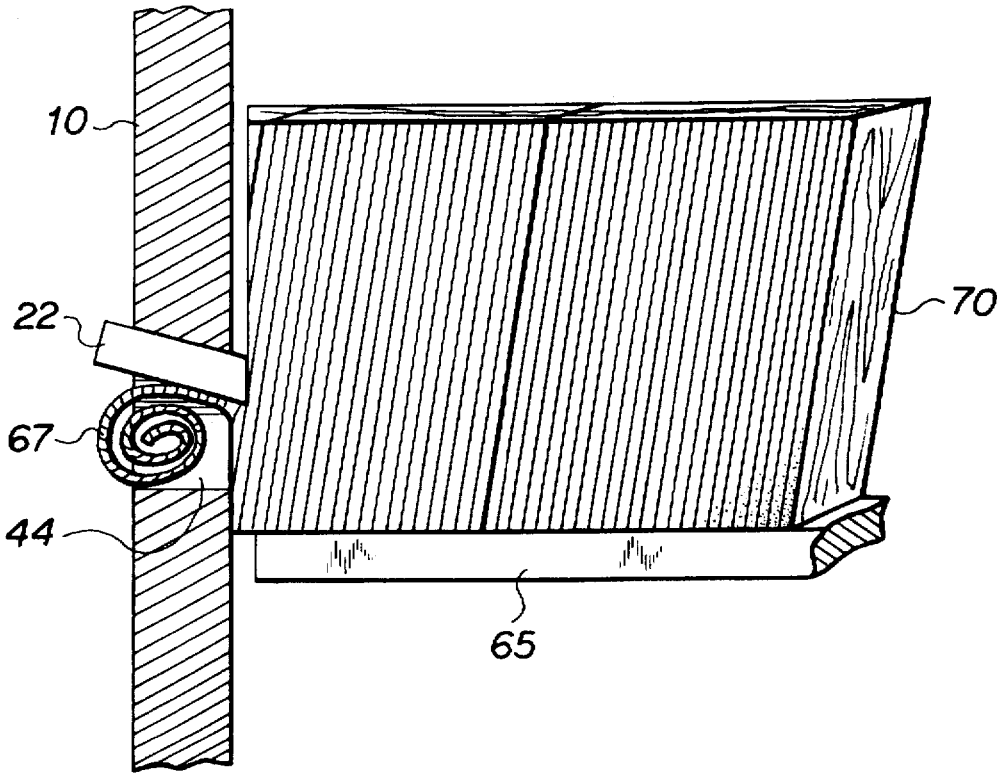
FIG. 19 is a side view cut-away showing a feed box with an angled platform and uneven sides to allow for an appropriate angle of tool motion to the wood grain and smooth continuous feeding of work pieces.
Figure 20:
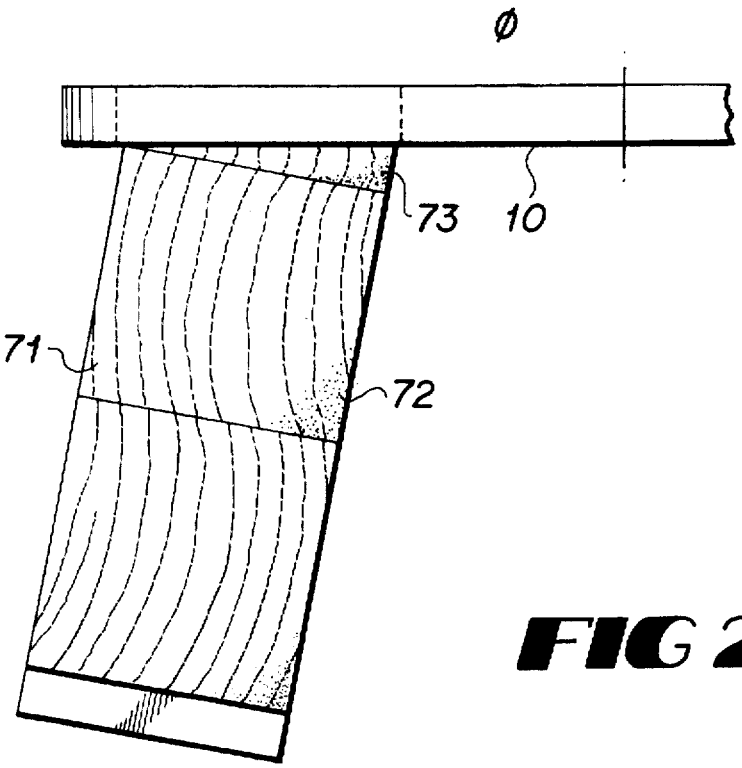
FIG. 20 is a top view showing a feed box with sides and base of unequal length so as to facilitate the continuous feeding of work pieces.
Figure 2A:
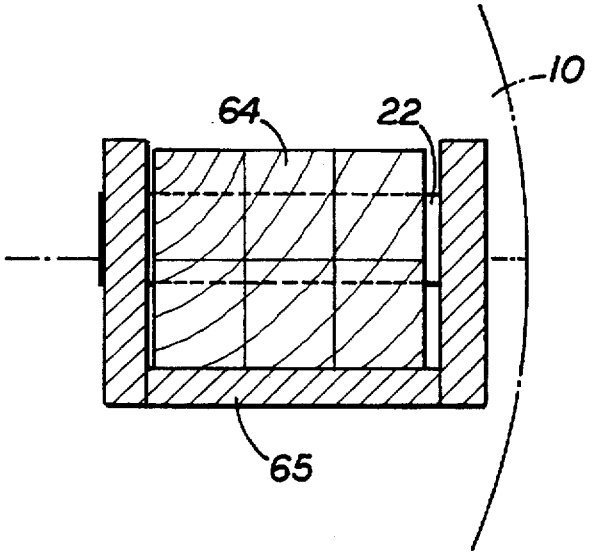
Figure 2B:
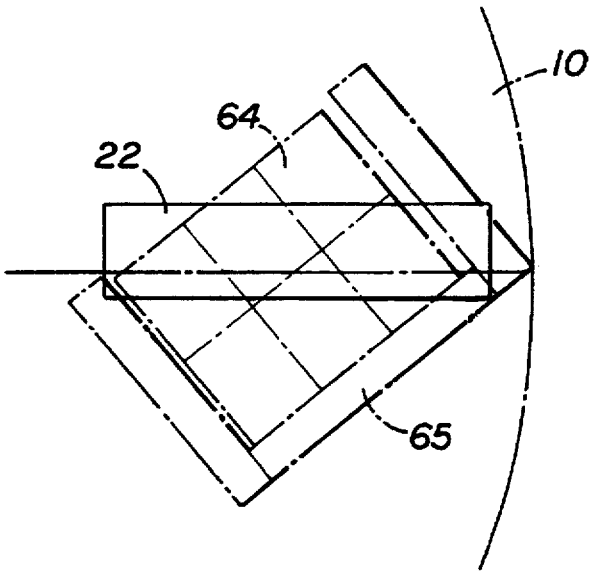
Figure 2C:
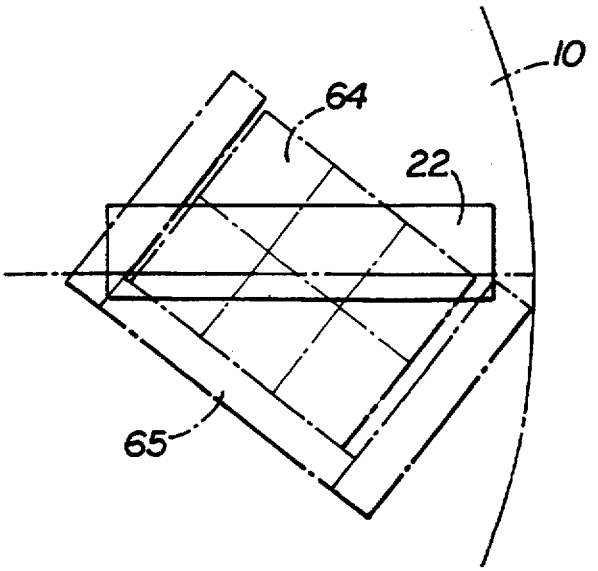

FIG. 18 illustrates that an appropriate angle of knife motion to the wood grain of the work piece is achieved in this apparatus through the use of an angled platform 65 upon which the work piece 64 is mounted. The bottom corner of the wood block facing the disc should be indexed against the disc to permit complete conversion of the wood block into curls. FIG. 19 illustrates that an appropriate angle of knife motion to wood grain may also be achieved by trimming the sides 70 of the work pieces being presented to the cutting blades. FIG. 20 illustrates a feed box with uneven sides 71, 72 and base. A feed box so constructed provides for more continuous and enhanced support of the terminal portion of the leading work piece, the leading work piece being the wood block being sliced into curls at any given time during a production run. As shown in FIG. 20, the enhanced support area 73 exists when the axis of the feed box is disposed at an angle other than perpendicular (90°) to the face of the disk 10. This enhanced support area 73 permits the terminal portion of the leading work piece and the front portion of the immediately following work piece to pass gradually, rather than abruptly, through the cutting plane of the knives 22 of the disk 10. This enhanced support area 73 also avoids the possibility that the terminal portion of the leading work piece may pass through into the output as an undesirable wedge of wood and not be completely cut into wood curls, thereby decreasing the desired uniformity of the output of the disc flaker. This enhanced support area 73 further avoids the possibility of a terminal corner of a work piece becoming wedged between the edge of the feed box and the work surface of the flaker during flaker operation.

An "angled" presentation of the work piece 64 may be achieved through various feed box modifications. As illustrated in FIGS. 21A–21C, one modification incorporates a means for permitting the feed box to be adjusted to occupy various loci throughout an eighty degree (80°) arc. When the feed box occupies the center of the arc, as shown in FIG. 21A, an angle of ninety degrees (90°) is made between the cutting edge of the knife 22 and the work piece 64. FIGS. 21B and 21C show the feed box rotated to the left and right, respectively, forty degrees (40°), illustrating that the feed box spans an eighty (80°) arc.

An alternative feed box modification is a vee shaped channel in which work pieces 64 may be fed to present such work pieces 64 to the cutting edge of the knife 22 in a similar "angled" manner. Examples of these vee shaped channels are illustrated in FIGS. 21B and 21C. A vee shaped channel can also be placed in the center of a feed box, which may be removable, into which work pieces 64 may be fed.

In order to facilitate curl removal, it would be convenient to mount the disc in bearings on the sides of a heavy metal channel frame with the disc positioned so that about 40% of it is in the channel and about 60% above the channel. The feed box should be adjusted so as to provide for maximum curl production. The precise location of the feed box will depend on factors, such as the disc diameter and the knife length. In general, the feed box will be positioned so that its base is, within the range of 2–7" below the centerline of the disc.

In order to fully convert the blocks of wood used to curls and avoid thick end pieces slipping by at the end of each block, the base of the feed box must be positioned very close to the cutting plane of the knife edges, preferably within a distance less than the thickness of a curl. To do this safely and minimize the risk of metal contacting metal during operation, it would be useful to have replaceable lips of wood or some other machinable material on the leading edges of the feed box bottom and sides.

Although the preferred embodiment of this invention has been described in detail, it is contemplated that modifications thereof may be made and some preferred features may be used without others, all within the spirit and scope of the broad invention.

I claim:

1. An apparatus for making wood curls, comprising:

(a) a rotatable disc having a work surface on the face of said disc and one or more elongated and narrow slots through said disc, and having a hollow center suitable for mounting said disc on a shaft;

(b) one or more cutting blades extending through said slots;

(c) a means for mounting said cutting blades on the edge of said slots of said disc whereby a rake angle in the range of zero to forty-five degrees (0°–45°) is made between the face of said cutting blades and a plane perpendicular to said work surface of said disc;

(d) a shaft upon which to securely mount said disc;

(e) a feed box for the placement of work pieces to be presented to the work surface of said disc;

(f) a means for directing work pieces placed in said feed box against said work surface of said disc as it rotates about said shaft causing said cutting blades to travel and contact said work pieces; and (g) sufficiently powerful means for causing said shaft to rotate with sufficient speed and force to permit said cutting blades to cut said work pieces to produce curled wood flakes.

2. The apparatus for making wood curls of claim 1 wherein said feed box has sides of uneven length to provide an enhanced base and side support area proximate to the work surface of said disc to fully support the terminal portions of the work piece being cut into curls during operation of the apparatus.

3. The apparatus for making wood curls of claim 1 wherein said feed box includes a vee shaped channel, into which work pieces may be fed to present said work pieces to the edges of said cutting blades to provide for angles in the range of forty-five degrees to ninety degrees (45°–90°) between the edge of said cutting blades and the grain of the wood of the work pieces.

4. An apparatus for making wood curls, comprising:

(a) a rotatable disc having a work surface on the face of said disc and one or more elongated and narrow slots through said disc, and having on the side opposite the work surface of said disc, a reduced disc thickness, in the region of the disc proximate to the elongated and narrow slots, to provide for a free flow of the wood curl product, and having a hollow center suitable for mounting said disc on a shaft;

(b) one or more cutting blades extending through said slots;

(c) a means for mounting said cutting blades on the edge of said slots of said disc whereby a rake angle in the range of zero to forty-five degrees (0°–45°) is made between the face of said cutting blades and a plane perpendicular to said work surface of said disc;

(d) a shaft upon which to securely mount said disc;

(e) a feed box for the placement of work pieces to be presented to the work surface of said disc;

(f) a means for directing work pieces placed in said feed box against said work surface of said disc as it rotates about said shaft causing said cutting blades to travel and contact said work pieces; and (g) sufficiently powerful means for causing said shaft to rotate with sufficient speed and force to permit said cutting blades to cut said work pieces to produce curled wood flakes.

5. An apparatus for making wood curls, comprising:

(a) a rotatable disc having a work surface on the face of said disc and one or more elongated and narrow slots through said disc, and having a hollow center suitable for mounting said disc on a shaft;

(b) one or more cutting blades extending through said slots;

(c) a means for mounting said cutting blades on the edge of said slots of said disc whereby a rake angle in the range of zero to forty-five degrees (0°–45°) is made between the face of said cutting blades and a plane perpendicular to said work surface of said disc;

(d) a shaft upon which to securely mount said disc;

(e) a feed box for the placement of work pieces to be presented to the work surface of said disc wherein said feed box has a base, which may be rotated in the horizontal plane through various loci of a eighty degree (80°) arc, such that when the feed box is located in the center of the arc, an angle of ninety degrees (90°) is made between the edge of said cutting blades and the grain of the work piece;

(f) a means for directing work pieces placed in said feed box against said work surface of said disc as it rotates about said shaft causing said cutting blades to travel and contact said work pieces; and (g) sufficiently powerful means for causing said shaft to rotate with sufficient speed and force to permit said cutting blades to cut said work pieces to produce curled wood flakes.

6. A method of producing curled wood flakes comprising the steps of:

(a) rotating a disk having at least one cutting blade having a rake angle in the range of zero to forty-five (0°–45°) attached to and projecting from said disk surface toward a work piece;

(b) placing the work piece in a feed box with a titled base and sides of uneven length to provide for an appropriate angle of the tool motion vector of the cutting blade and the grain of the work piece and to fully support the terminal portions of the work piece being cut into curls;

(c) directing said work piece against said disk surface; and (d) continuously rotating said disk to cause said cutting blade to cut the work piece into curled wood flakes.

7. A method of producing curled wood flakes comprising the steps of:

(a) rotating a disk having at least one cutting blade having a rake angle in the range of zero to forty-five (0°–45°) attached to and projecting from said disk surface toward a work piece;

(b) placing the work piece in a feed box with sides of uneven length so as to provide for an enhanced feed box base support area proximate to the work surface of said disk and said shaft of said disk;

(c) directing said work piece against said disk surface; and (d) continuously rotating said disk to cause said cutting blade to cut the work piece into curled wood flakes.

8. A method of producing curled wood flakes comprising the steps of:

(a) providing a rotatable disk having at least one cutting blade having a rake angle in the range of zero to forty-five (0°–45°) attached to and projecting from said disk surface toward a work piece;

(b) placing the work piece in a feed box for presenting work pieces to said cutting blades such that the angle made between the tool motion vector of said cutting blades and the grain of the work pieces is in the range of zero to twenty degrees (0°–20°);

(c) directing said work piece against said disk surface; and (d) continuously rotating said disk to cause said cutting blade to cut the work piece into curled wood flakes.

* * * * *